US006977669B2

(12) United States Patent
Shih et al.

(10) Patent No.: US 6,977,669 B2
(45) Date of Patent: Dec. 20, 2005

(54) PREVENTING CREASE FORMATION IN DONOR WEB IN DYE TRANSFER PRINTER THAT CAN CAUSE LINE ARTIFACT ON PRINT

(75) Inventors: Po-Jen Shih, Webster, NY (US); Zhanjun Gao, Rochester, NY (US); Robert F. Mindler, Churchville, NY (US); Roger A. Fields, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/789,021

(22) Filed: Feb. 26, 2004

(65) Prior Publication Data

US 2005/0195270 A1 Sep. 8, 2005

(51) Int. Cl.[7] ..... B41J 35/08
(52) U.S. Cl. ..... 347/215; 347/220; 347/217
(58) Field of Search ..... 347/215, 216, 347/217, 220; 400/234, 247, 248

(56) References Cited

U.S. PATENT DOCUMENTS

| | | | | |
|---|---|---|---|---|
| 4,739,341 | A * | 4/1988 | Matsuno et al. | 347/172 |
| 6,380,964 | B1 | 4/2002 | Tanaka | |
| 6,549,224 | B2 | 4/2003 | Connor | |
| 6,757,003 | B1 * | 6/2004 | Gao et al. | 347/220 |
| 6,762,783 | B1 * | 7/2004 | Gao et al. | 347/216 |
| 6,768,503 | B1 * | 7/2004 | Shih et al. | 347/216 |
| 6,812,945 | B2 * | 11/2004 | Gao et al. | 347/216 |

FOREIGN PATENT DOCUMENTS

| | | | |
|---|---|---|---|
| GB | 2289443 | * 11/1995 | B41J 2/325 |
| JP | 56-028880 | 3/1981 | |
| JP | 59-068282 | 4/1984 | |
| JP | 60-157889 | 8/1985 | |
| JP | 01-110175 | 4/1989 | |
| JP | 06-171170 | 6/1994 | |
| JP | 07-178993 | 7/1995 | |
| JP | 08-230262 | 9/1996 | |
| JP | 09-039349 | 2/1997 | |

* cited by examiner

*Primary Examiner*—Huan Tran
(74) *Attorney, Agent, or Firm*—Mark G. Bocchetti

(57) ABSTRACT

A thermal printer is adapted to prevent crease formation in successive dye transfer areas of a dye donor web that can cause line artifacts to be printed on a dye receiver during dye transfer from each dye transfer area to the dye receiver in a dye transfer printer.

19 Claims, 15 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATIONS

Cross-reference is made to commonly assigned, co-pending applications Ser. No. 10/776,746, entitled PREVENTING CREASE FORMATION IN DONOR WEB IN DYE TRANSFER PRINTER THAT CAN CAUSE LINE ARTIFACT ON PRINT, and filed Feb. 11, 2004 in the names of Eric Connor, Po-Jen Shih, and Zhanjun J. Gao; Ser. No. 10/426,591, entitled PREVENTING CREASE FORMATION IN DONOR WEB IN DYE TRANSFER PRINTER THAT CAN CAUSE LINE ARTIFACT ON PRINT, and filed Apr. 30, 2003 in the names of Po-Jen Shih, Zhanjun J. Gao, and Robert F. Mindler; Ser. No. 10/394,888, entitled PREVENTING CREASE FORMATION IN DONOR WEB IN DYE TRANSFER PRINTER THAT CAN CAUSE LINE ARTIFACT ON PRINT, and filed Mar. 21, 2003 in the names of Zhanjun J. Gao, Po-Jen Shih, and Robert F. Mindler; and Ser. No. 10/391,175, entitled PREVENTING CREASE FORMATION IN DONOR WEB IN DYE TRANSFER PRINTER THAT CAN CAUSE LINE ARTIFACT ON PRINT, and filed Mar. 18, 2003 in the names of Zhanjun J. Gao, John F. Corman, Robert F. Mindler, Po-Jen Shih, and Theodore J. Skomsky.

FIELD OF THE INVENTION

The invention relates generally to dye transfer or thermal printers. More particularly, the invention relates to the problem of creases or wrinkles being formed in the dye transfer areas of a dye donor web during dye transfer printing. Crease formation in a dye transfer area can result in an undesirable line artifact being printed on a dye receiver.

BACKGROUND OF THE INVENTION

A typical multi-color dye donor web that is used in a dye transfer or thermal printer is substantially thin and has a repeating series of three different rectangular-shaped color sections or patches such as a yellow color section, a magenta color section and a cyan color section. In addition, there may be a transparent colorless laminating section immediately after the cyan color section.

Each color section of the dye donor web consists of a dye transfer area which is used for dye transfer printing and a pair of opposite longitudinal edge areas alongside the dye transfer area which often are not used for printing. The dye transfer area may be about 152 mm wide and the two longitudinal edge areas may each be about 5.5 mm wide, so that the total web width is approximately 163 mm.

To make a multi-color image print using a thermal printer, a motorized donor web take-up spool draws a longitudinal portion of the dye donor web off a donor web supply spool in order to successively move an unused single series of yellow, magenta and cyan color sections over a stationary liner array (bead) of selectively heated resistive elements on a thermal print head between the supply and take-up spools. Respective color dyes within the yellow, magenta and cyan color sections are successively heat-transferred line-by-line, via the selectively heated resistive elements, onto a dye receiver medium such as a paper or transparency sheet or roll, to form the color image print. The selectively heated resistive elements often extend across the entire width of a color section, i.e. across the dye transfer area and the two longitudinal edge areas comprising that color section. However, only those resistive elements that contact the dye transfer area are selectively heated. Those resistive elements that contact the two longitudinal edge areas are not heated. Consequently, the dye transfer occurs from the dye transfer area to the dye receiver medium, but not from the two longitudinal edge areas to the dye receiver medium.

As each color section is drawn over the selectively heated resistive elements, it is subjected to a longitudinal tension particularly by the forward pulling force of the motorized donor web take-up spool. Since the dye transfer area in the color section is heated by the resistive elements, but the two longitudinal edge areas alongside the dye transfer area are not, the dye transfer area is significantly weakened and therefore is vulnerable to being longitudinally stretching as compared to the two edge areas. Consequently, the longitudinal tension will stretch the dye transfer area relative to the two longitudinal edge areas. This stretching causes the dye transfer area to become thinner than the non-stretched edge areas, which in turn causes some creases or wrinkles to develop in the dye transfer area, most acutely in those regions of the dye transfer area that are close to the non-stretched longitudinal edge areas. The creases or wrinkles occur most acutely in the regions of the dye transfer area that are close to the non-stretched edge areas because of the sharp, i.e. abrupt, transition between the stretched (thinner) transfer area and the non-stretched (thicker) edge areas.

As the dye donor web is pulled by the motorized donor web take-up spool over the selectively heated resistive elements, the creases or wrinkles tend to spread from a trailing (rear) end portion of a used dye transfer area at least to a leading (front) end portion of the next dye transfer area to be used. A known problem that can result is that the creases in the leading (front) end portion of the next dye transfer area to be used will cause undesirable line artifacts to be printed on a leading (front) end portion of the dye receiver medium. The line artifacts printed on the dye receiver medium, although they may be relatively short, are quite visible.

The question presented therefore is how to solve the problem of the creases or wrinkles being created in an unused dye transfer area so that no line artifacts are printed on the dye receiver medium during the dye transfer.

THE CROSS-REFERENCED APPLICATIONS

The cross-referenced applications each disclose a thermal printer capable of preventing crease formation in successive dye transfer areas of a dye donor web that can cause line artifacts to be printed on a dye receiver during dye transfer from each dye transfer area to the dye receiver.

To prevent crease formation in cross-referenced application Ser. No. 10/391,175, there is provided a crease-preventing platen roller that has a pair of roller end portions that apply a constant pressure against the two longitudinal edge areas alongside the dye transfer area, and a roller main portion between the roller end portions that applies a lesser pressure against the dye transfer area. Since the pressure applied against the two edge areas is greater than the pressure applied against the dye transfer area, the mechanical friction applied against the two edge areas is greater than the mechanical friction applied against the dye transfer area, so that the two edge areas will be stretched substantially the same as the dye transfer area. As a result, creases will not be formed in the dye transfer area. This is so even though the dye transfer area is heated by the print head, but the two edge areas are not.

To prevent crease formation in cross-referenced application Ser. No. 10/776,746, there is provided a series of pressure applicators that adjust pressure contact of the print head with the dye transfer area and two edge areas to prevent the dye transfer area from being longitudinally stretched relative to the two edge areas. Since the dye transfer area cannot be stretched relative to the two edge areas, crease formation is prevented. Pressure contact is adjusted in accordance with differences in temperature sensed widthwise across the dye transfer area and two edge areas.

To prevent crease formation in cross-referenced application Ser. No. 10/426,591 and Ser. No. 10/394,888, there is provided a crease-preventing platen roller that has respective web spreading portions that are similarly spiraled inwardly from opposite coaxial ends of the platen roller to urge the dye transfer area and two edge areas to spread towards the coaxial ends in opposition to crease formation during dye transfer from the dye transfer area to the dye receiver.

SUMMARY OF THE INVENTION

According to the invention, there is provided a thermal printer capable of preventing crease formation in successive dye transfer areas of a dye donor web that can cause line artifacts to be printed on a dye receiver during dye transfer from each dye transfer area to the dye receiver. The printer comprises:

a thermal print head for heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

a crease-preventing platen roller movable to adjacent the print head for supporting both the dye receiver and the dye transfer area and two edge areas partially wrapped longitudinally about the platen roller, so that respective wrap angles are formed for the dye receiver and for the dye transfer area and two edge areas relative to the platen roller, and being configured to urge the dye transfer area and two edge areas to spread in opposition to crease formation during dye transfer from the dye transfer area to the dye receiver; and a wrap angle regulator movable for increasing at least the wrap angle of the dye transfer area and two edge areas relative to the crease-preventing platen roller, whereby the platen roller can urge more of the dye transfer area and two edge areas to spread.

Preferably, a sensor and control device is included for sensing temperature and/or longitudinal tension of the dye transfer area and two edge areas at the print head to determine whether the wrap angle of the dye transfer area and two edge areas should be increased. Increasing the wrap angle of the dye transfer area and two edge areas allows the crease-preventing platen roller to urge more of the dye transfer area and two edge areas to spread.

DETAILED DESCRIPTION OF THE INVENTION

Dye Donor Web

Figure 1:
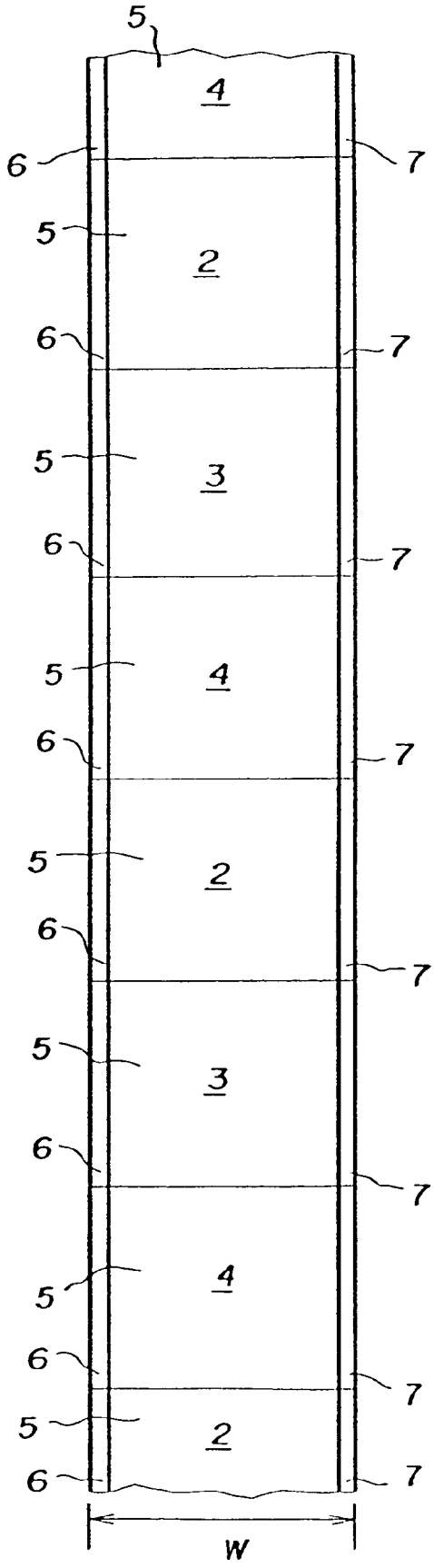
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a dye transfer or thermal printer. The dye donor web 1 is substantially thin and has a repeating series (only two completely shown) of three different rectangular-shaped color sections or patches such as a yellow color section 2, a magenta color section 3 and a cyan color section 4. In addition, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 which is used for printing and a pair of similar-colored opposite longitudinal edge areas 6 and 7 alongside the dye transfer area which often are not used for printing. Preferably, the dye transfer area 5 is about 152 mm wide and the two edge areas 6 and 7 are each about 5.5 mm wide, so that the total web width W is approximately 163 mm.

Dye Transfer or Thermal Printer

FIGS. 2–6 depict operation of a dye transfer or thermal printer 10 using the dye donor web 1 shown in FIG. 1 to effect successive yellow, magenta and cyan dye transfers onto a known dye receiver sheet 12 such as paper or a transparency.

Initialization

Figure 2:
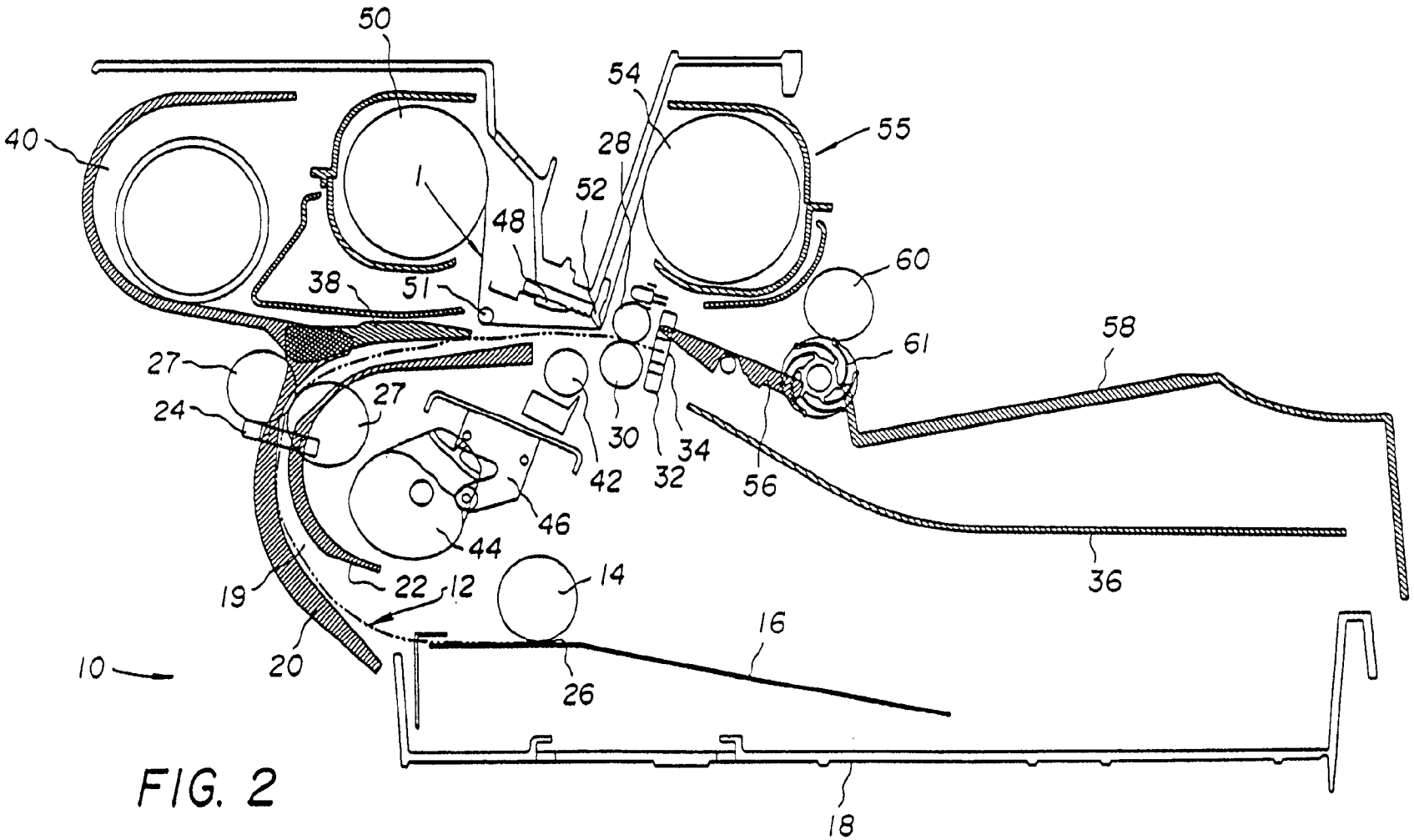
FIG. 2 is an elevation view, partly in section, of a dye transfer or thermal printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing (rear) edge 26 of the dye receiver sheet 12, it activates at least one of pair of motorized parallel-axis urge rollers 27, 27 in the channel 19. The activated rollers 27, 27 then advance the dye receiver sheet 12 forward (to the right in FIG. 2) through the nip of a motorized capstan roller 28 and a pinch roller 30, positioned beyond the channel 19, and to a leading (front) edge sensor 32.

Figure 3:
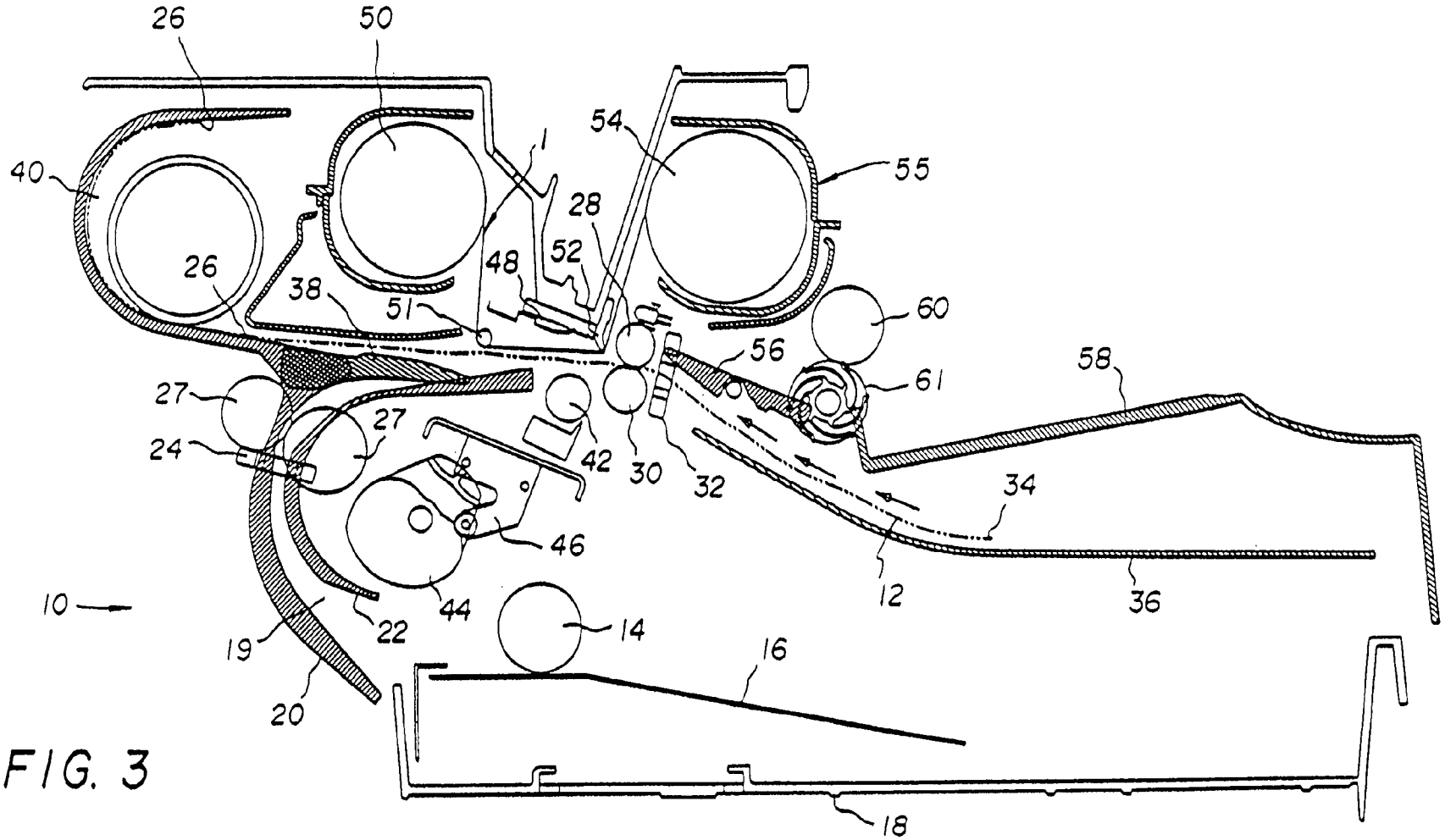
FIGS. 3 and 4 are elevation views, partly in section, of the dye transfer printer, showing successive dye transfer cycles during the printer operation.

In FIG. 3, the leading edge sensor 32 has sensed a leading (front) edge 34 of the dye receiver sheet 12 and activated the motorized capstan roller 28 to cause that roller and the pinch roller 30 to advance the dye receiver sheet forward partially onto an intermediate tray 36. The dye receiver sheet 12 is advanced forward onto the intermediate tray 36 so that the trailing (rear) edge 26 of the dye receiver sheet can be moved beyond a hinged exit door 38 that is a longitudinal extension of the curved guide 20. Then, as illustrated, the hinged exit door 38 closes and the capstan and pinch rollers 28 and 30 are reversed to advance the dye receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
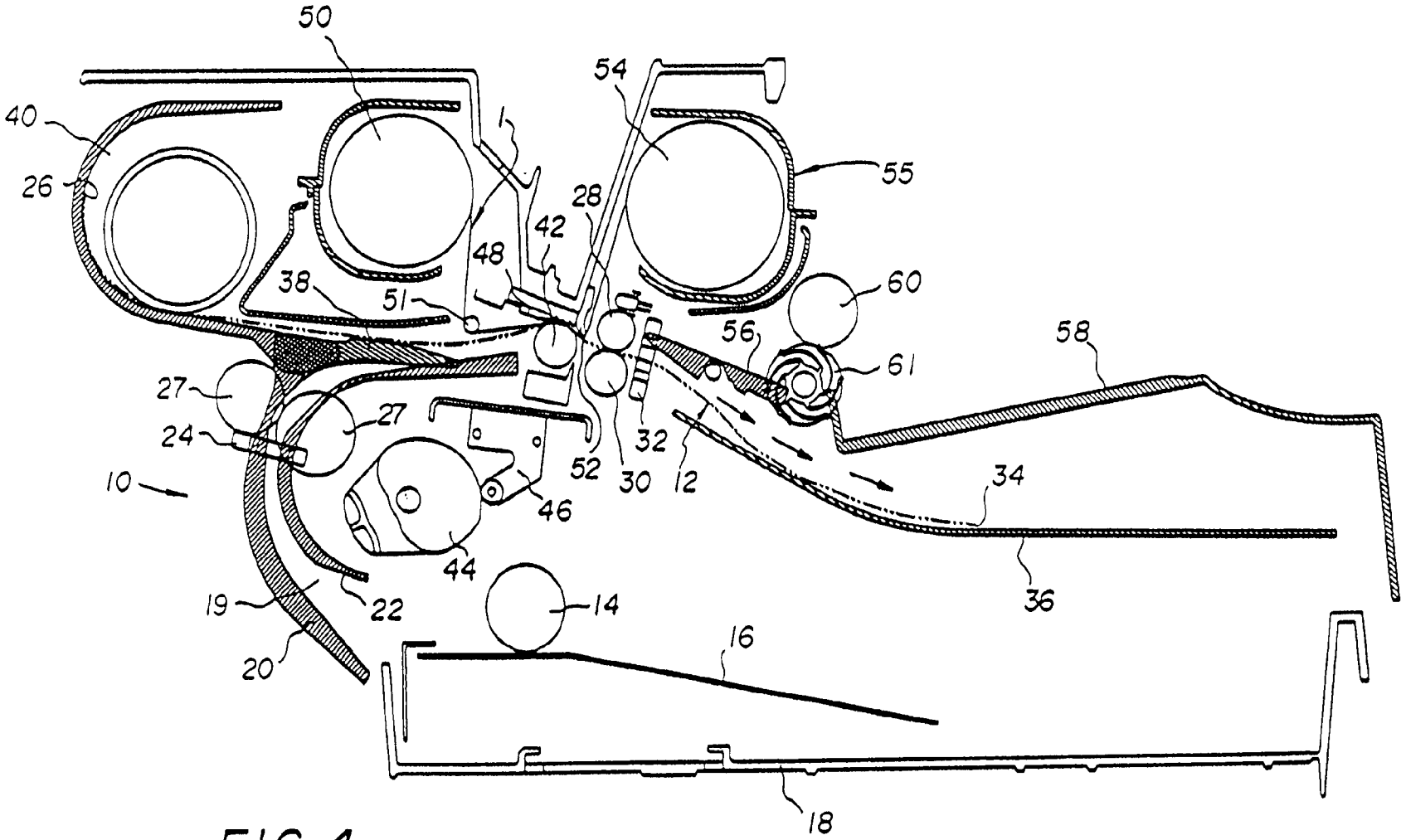
Figure 5:
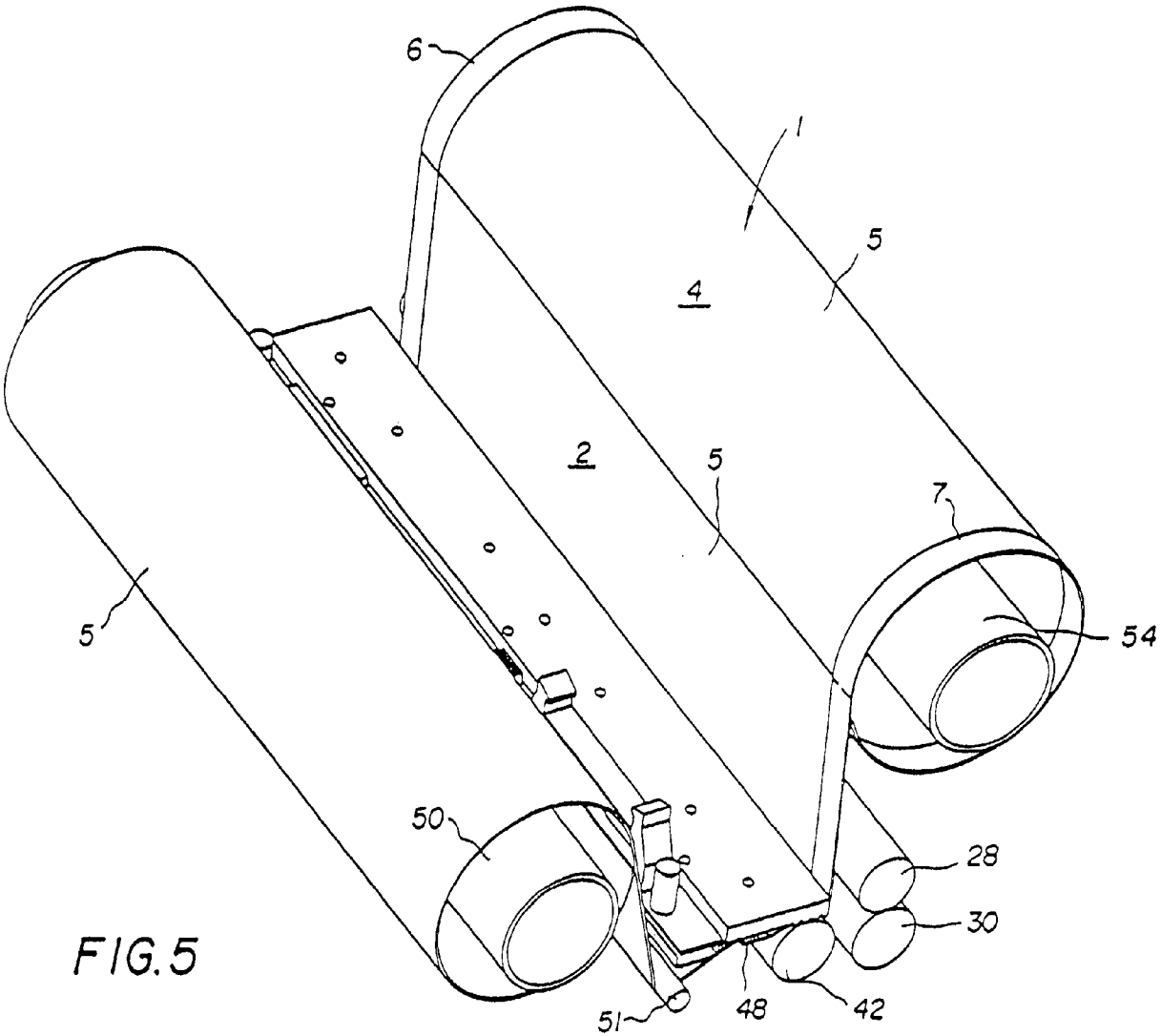
FIG. 5 is perspective view of a printing or dye transfer station in the dye transfer printer.

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together in a pressured relation between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a first stationary donor web guide bar 51, over the print head 48, and over a second stationary donor web guide bar or stripper 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable donor web cartridge 55 that is manually loaded into the printer 10.

Figure 7:
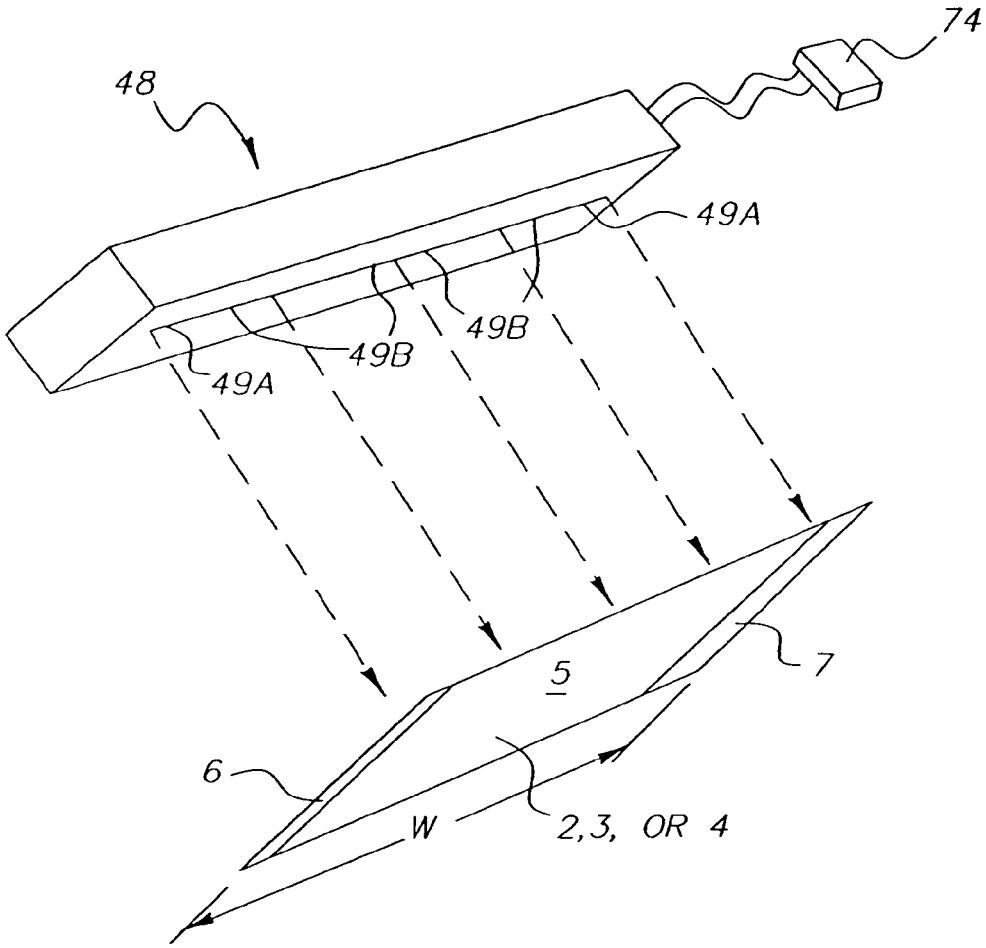
FIG. 7 is a perspective view of a linear array (bead) of selectively heated resistive elements on a thermal print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a linear array (bead) of selectively heated, closely spaced, resistive elements 49A, 49A, *, 49B, 49B, *, and 49A, 49A, *, on the print head 48 that make pressured print-line-contact across the entire width W of the yellow color section 2, i.e. across its dye transfer area 5 and the two edge areas 6 and 7 alongside the transfer area. As shown in FIG. 7, the resistive elements 49A make pressured contact with the edge areas 6 and 7 and the resistive elements 49B make similar contact with the dye transfer area 5. However, only the resistive elements 49B are selectively heated sufficiently to cause the yellow dye transfer from the dye transfer area 5 to the dye receiver sheet 12. The yellow dye transfer is done one line at a time, i.e. row-by-row, widthwise across the dye transfer area 5. The resistive elements 49A are not heated (or only slightly heated) so that there is no yellow dye transfer from the edge areas 6 and 7 to the dye receiver sheet 12**.

A known heat activating control 74, preferably including a suitably programmed microcomputer using known programming techniques, is connected individually to the resistive elements 49A, 49A, *, 49B, 49B, *, 49A, 49A, *, to selectively heat those resistive elements 49B that make pressured print-line-contact with the dye transfer area 5, and preferably not heat (or only slightly heat) those resistive elements 49A that make pressured contact with the two edge areas 6 and 7 alongside the dye transfer area. See FIG. 7**.

As the yellow color section 2 of the dye donor web 1 is used for dye transfer line-by-line, it is pulled forward from the print head 48 and over the second stationary donor web guide bar or stripper 52 in FIG. 4. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) cyan color section 4 of the dye donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing (rear) edge 26 first, partially into the rewind chamber 40. See FIG. 3.

Final

Figure 6:
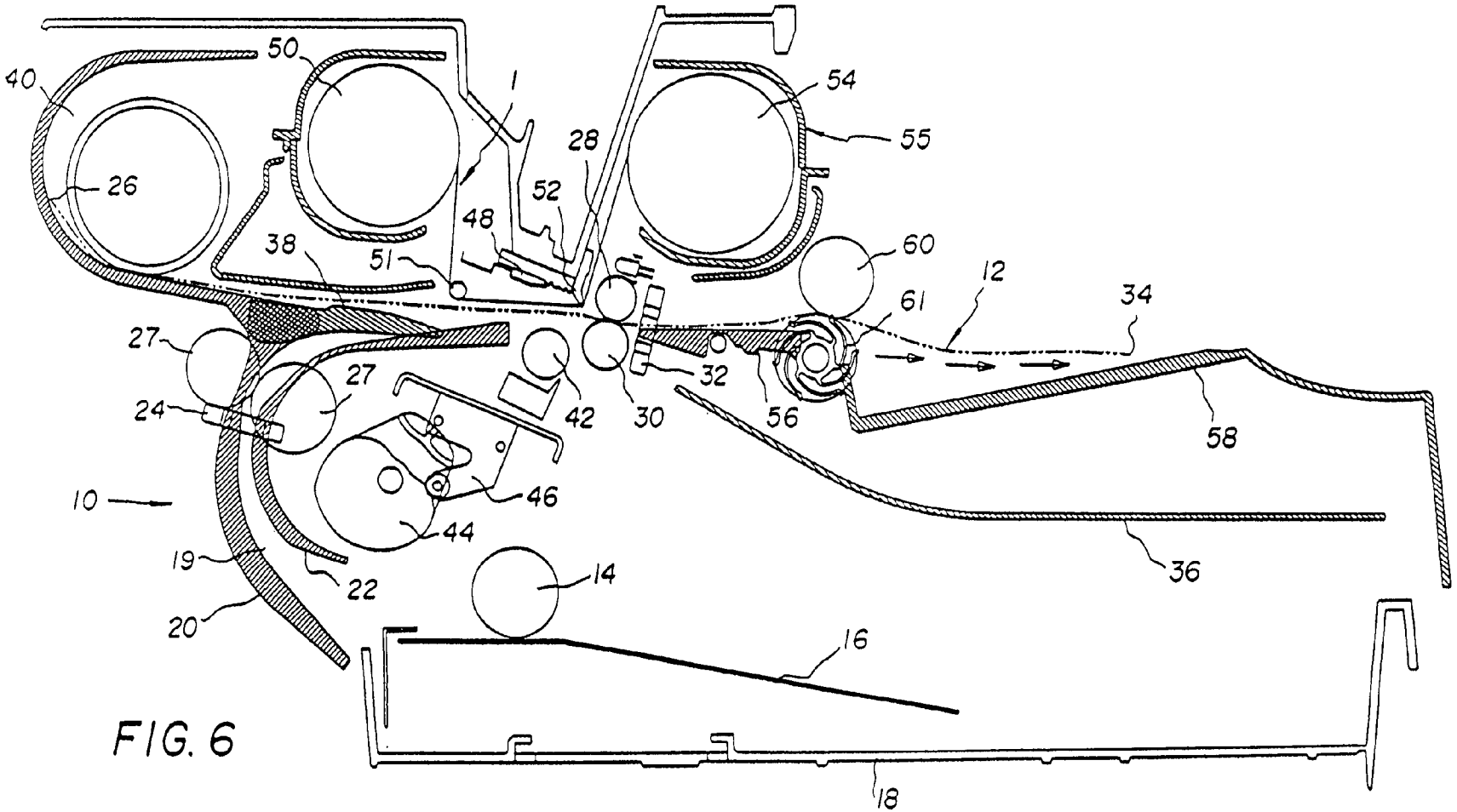
FIG. 6 is an elevation view, partly in section, of the dye transfer printer, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
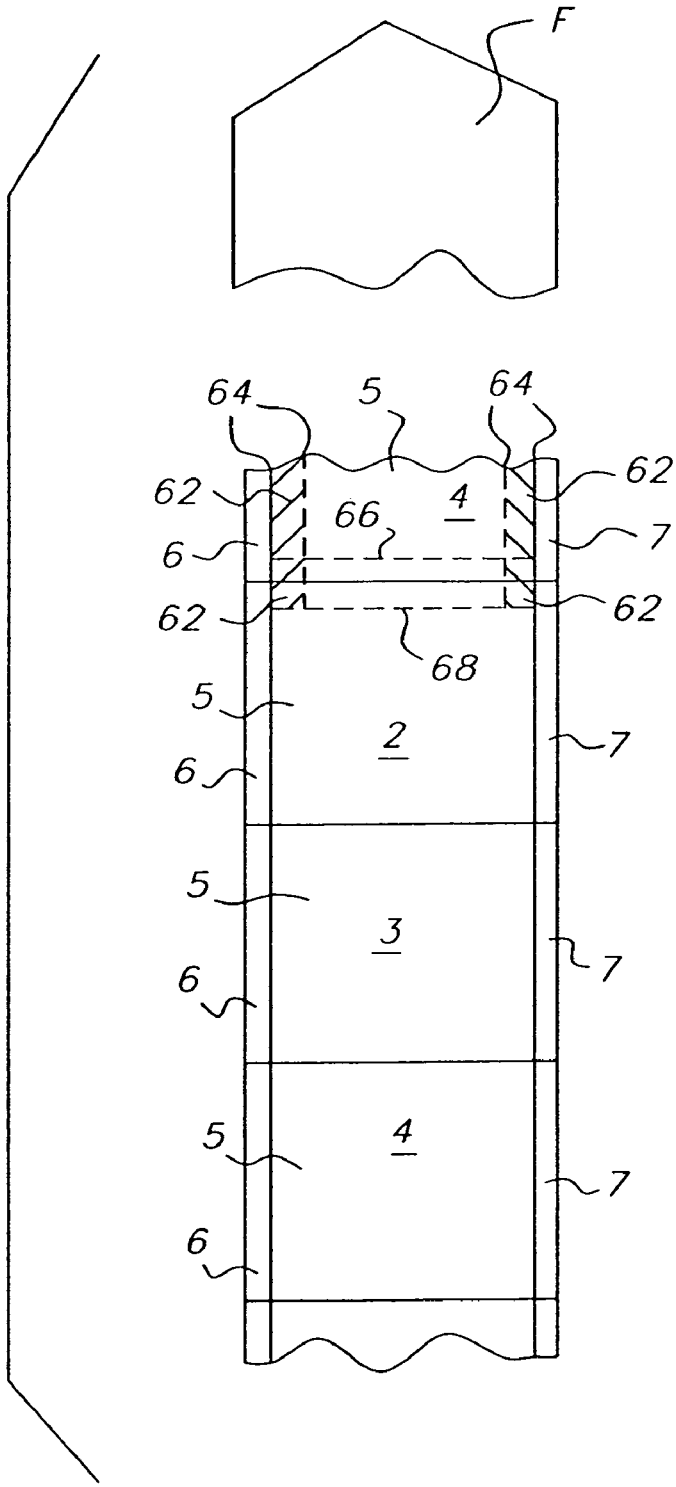
FIG. 8 (PRIOR ART)
FIG. 8 (PRIOR ART) is a plan view of a portion of the dye donor web, showing creases or wrinkles spreading rearward from a trailing (rear) end portion of a used dye transfer area into a leading (front) end portion of an unused dye transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is pulled or drawn forward over the linear array (bead) of selectively heated resistive elements 49A, 49A, *, 49B, 49B, *, 49A, 49A, *, the color section is subjected to a longitudinal tension imposed substantially by a forward pulling force F of the motorized donor web take-up spool 54. See FIG. 8. Moreover, since the dye transfer area 5 is heated by the resistive elements 49B, but the two edge areas 6 and 7 alongside the dye transfer area are not heated by the resistive elements 49A, the dye transfer area is significantly weakened in relation to the two edge areas and therefore becomes more susceptible or vulnerable to being stretched than the two edge areas. See FIG. 7. Consequently, the longitudinal tension imposed by the forward pulling force F of the motorized take-up spool 54 can longitudinally stretch the dye transfer area 5 relative to the two edge areas 6 and 7. As is known, this stretching causes the dye transfer area 5 to become thinner than the non-stretched edge areas 6 and 7, which in turn causes slanted creases or wrinkles 62 to develop in the dye transfer area, most acutely in those regions 64 of the dye transfer area that are close to the two edge areas. See FIG. 8. The slanted creases or wrinkles 62 occur most acutely in the regions 64 of the dye transfer area 5 that are close to the two edge areas 6 and 7** because of the sharp, i.e. abrupt, transition between the weakened transfer area and the stronger edge areas.

Figure 9:
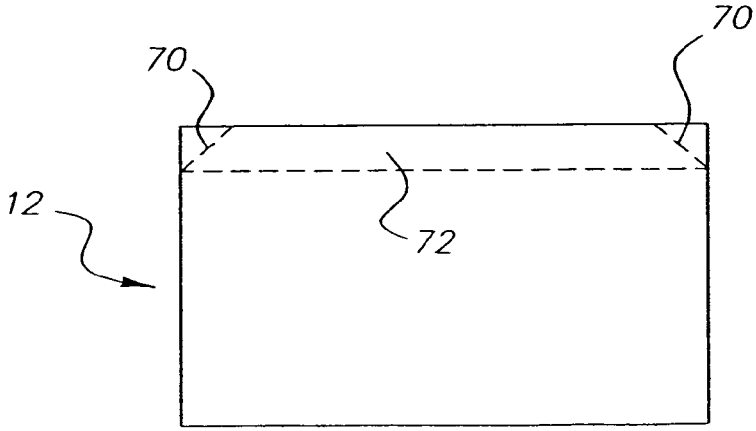
FIG. 9 (PRIOR ART)
FIG. 9 (PRIOR ART) is a plan view of a dye receiver sheet, showing line artifacts printed on a leading (front) edge portion of the dye receiver sheet.

As the dye donor web 1 is pulled by the motorized donor web take-up spool 54 over the linear array (bead) of selectively heated resistive elements 49A, 49A, *, 49B, 49B, *, 49A, 49A *, the slanted creases or wrinkles 62 tend to spread rearward from a trailing (rear) end portion 66 of a used dye transfer area 5 at least to a leading (front) end portion 68 of the next dye transfer area to be used. See FIG. 8. A problem that can result is that the slanted creases or wrinkles 62 in the leading or front end portion 68 of the next dye transfer area 5 to be used will cause undesirable line artifacts 70 to be printed on a leading (front) end portion 72 of the dye receiver sheet 12, when the dye transfer occurs at the creases in the leading end portion of the next transfer area to be used. See FIG. 9. The line artifacts 70 printed on the dye receiver sheet 12**, although they may be relatively short, are quite visible.

The question presented therefore is how to solve the problem of the slanted creases or wrinkles 62 being created in an unused transfer area 5 so that no line artifacts 70 are printed on the dye receiver sheet 12 during the dye transfer.

Solution

As previously mentioned, before each yellow, magenta or cyan dye transfer from a dye transfer area 5 to the dye receiver sheet 12, the platen roller 42 is shifted via the rotated cam 44 and the platen lift 46 to adjacent the print head 48. This causes both the dye receiver sheet 12 and an unused yellow, magenta or cyan color section 2, 3 or 4 (comprising a dye transfer area 5 and two edge areas 6 and 7) of the donor web 1 to be intimately held together between the platen roller 42 and the print head 48. The platen roller 42 shown in FIGS. 2–6 is an ordinary cylindrical (uniform diameter) roller and, as such, it is substantially ineffective to prevent the slanted creases 62 from forming in the dye transfer area 5, including in the regions 64 of the dye transfer area that are close to the two edge areas 6 and 7, during the dye transfer. See FIG. 8.

Figure 11:
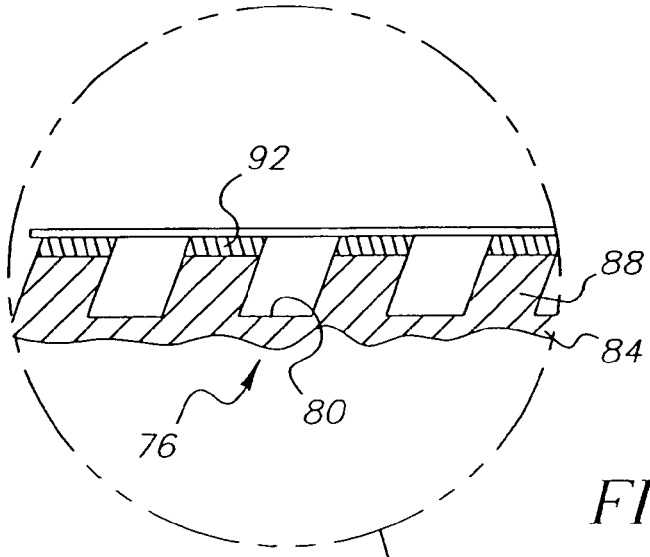
FIG. 11 is an enlarged view of a portion of the crease-preventing platen roller in FIG. 10.
Figure 10:
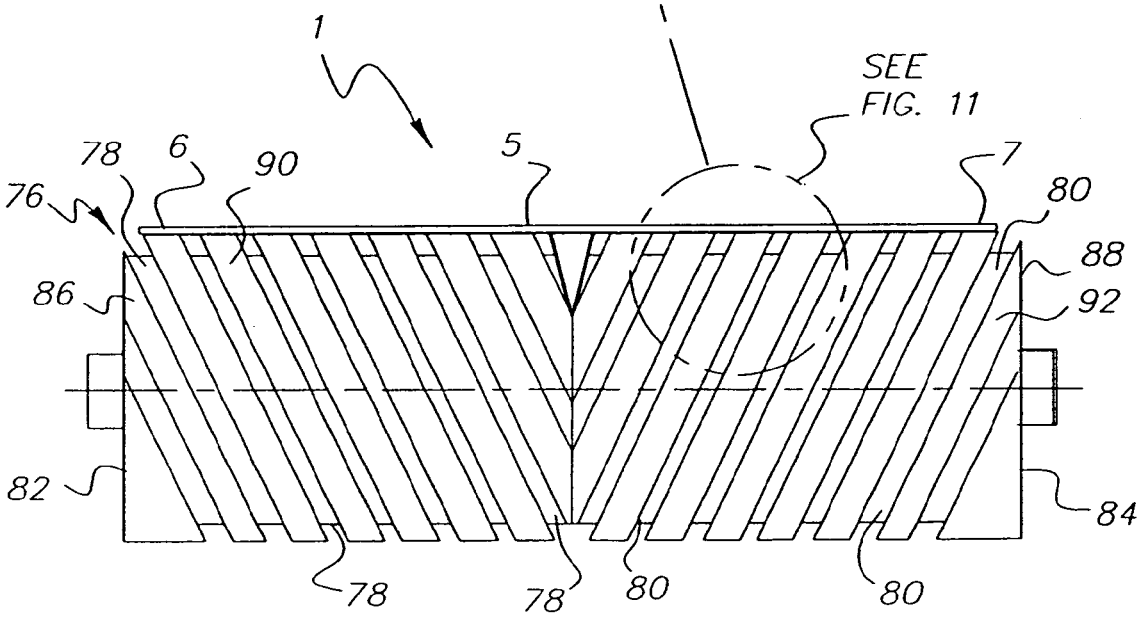
FIG. 10 is an elevation view of one example of a crease-preventing platen roller that is intended to be used in the dye transfer printer in place of a prior art non-crease-preventing platen roller in FIGS. 2–6.
Figure 12:
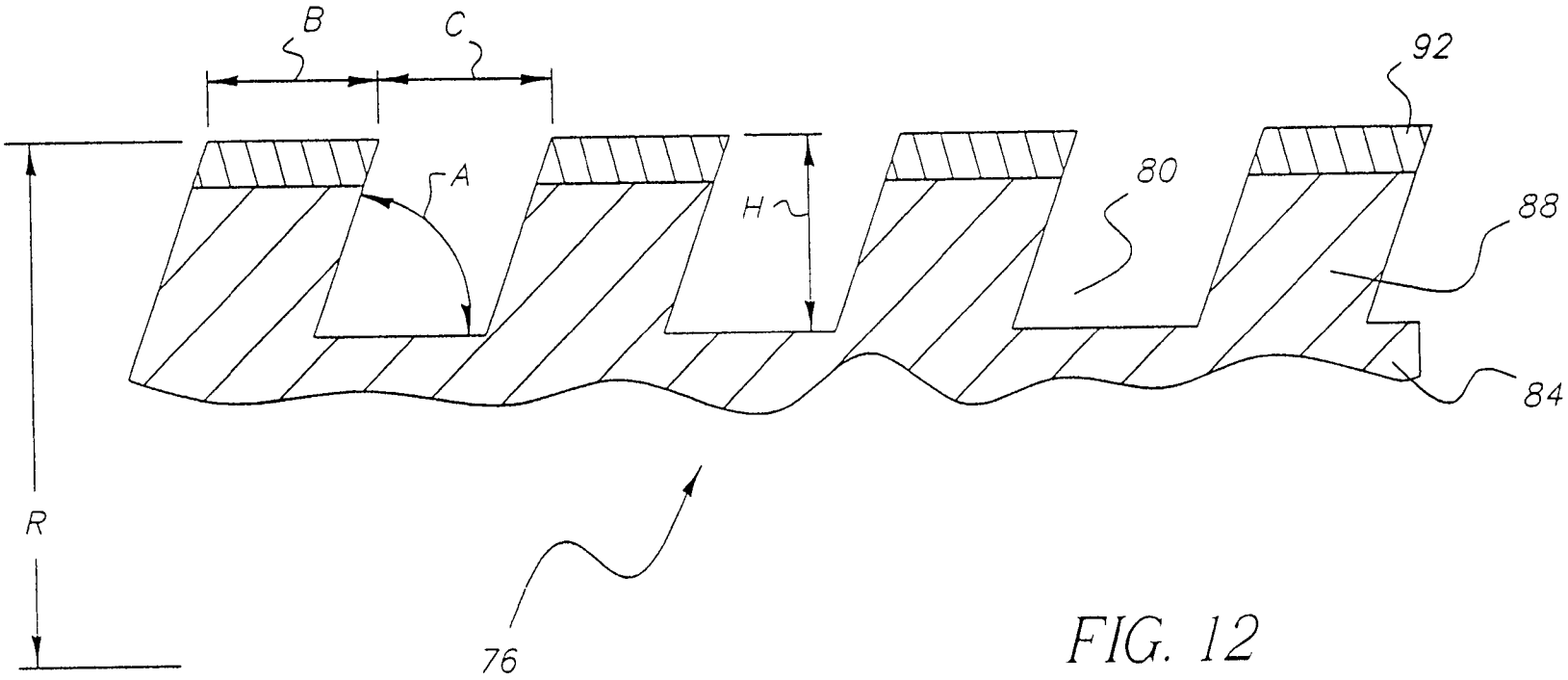
FIG. 12 is a further enlargement of the portion of the crease- preventing platen roller in FIG. 11.

According to a preferred embodiment of the invention, FIGS. 10–12 show one example of a crease-preventing platen roller 76 that is used in place of the platen roller 42 in FIGS. 2–6. The crease-preventing platen roller 76, unlike the platen roller 42, prevents the slanted creases 62 from forming in the dye transfer area 5, including in the regions 64 of the dye transfer area that are close to the two edge areas 6 and 7, during the dye transfer when the crease-preventing platen roller is adjacent the print head 48. See FIG. 8.

The crease-preventing platen roller 76 has opposed helical grooves 78 and 80 that are spiraled inwardly in respective directions from coaxial opposite ends 82 and 84 of the roller to form resilient helical ribs 86 and 88. The helical ribs 86 and 88 meet midway between the roller ends 82 and 84, and they have respective web traction surface layers 90 and 92 that are less resilient than the remainders of the ribs. For example, the web traction surface layers 90 and 92 may be a hard rubber or other suitable elastic substance, and the remainders of the ribs 86 and 88 may be a softer rubber or other suitable elastic substance.

As indicated in FIGS. 10–12, the helical ribs 86 are inclined towards the roller end 82, and the helical ribs 88 are inclined towards the roller end 84 and 88. The helical ribs 86 are each inclined an acute angle A towards the roller end 82, and the helical ribs 88 are each inclined the same angle A towards the roller end 84. Preferably, the acute angle A is within the range of 60°–85°. Also, the helical ribs 86 and 88 have the same width B. Preferably, the width B of the helical ribs 86 and 88 divided by the radius R of the crease-preventing roller 76 is within the range of 0.1–0.5, i.e. 10%–50%. Similarly, the helical grooves 78 and 80 have the same width C, and the width of the helical grooves divided by the radius R of the cease-preventing roller 76 preferably is within the range of 0.1–0.5, i.e. 10%–50%. The helical ribs 86 and 88 have the same height H. Preferably, the height H of the helical ribs 86 and 88 divided by the radius R of the crease-preventing roller 76 is within the range of 0.1–0.25, i.e. 10%–25%.

Figure 13:
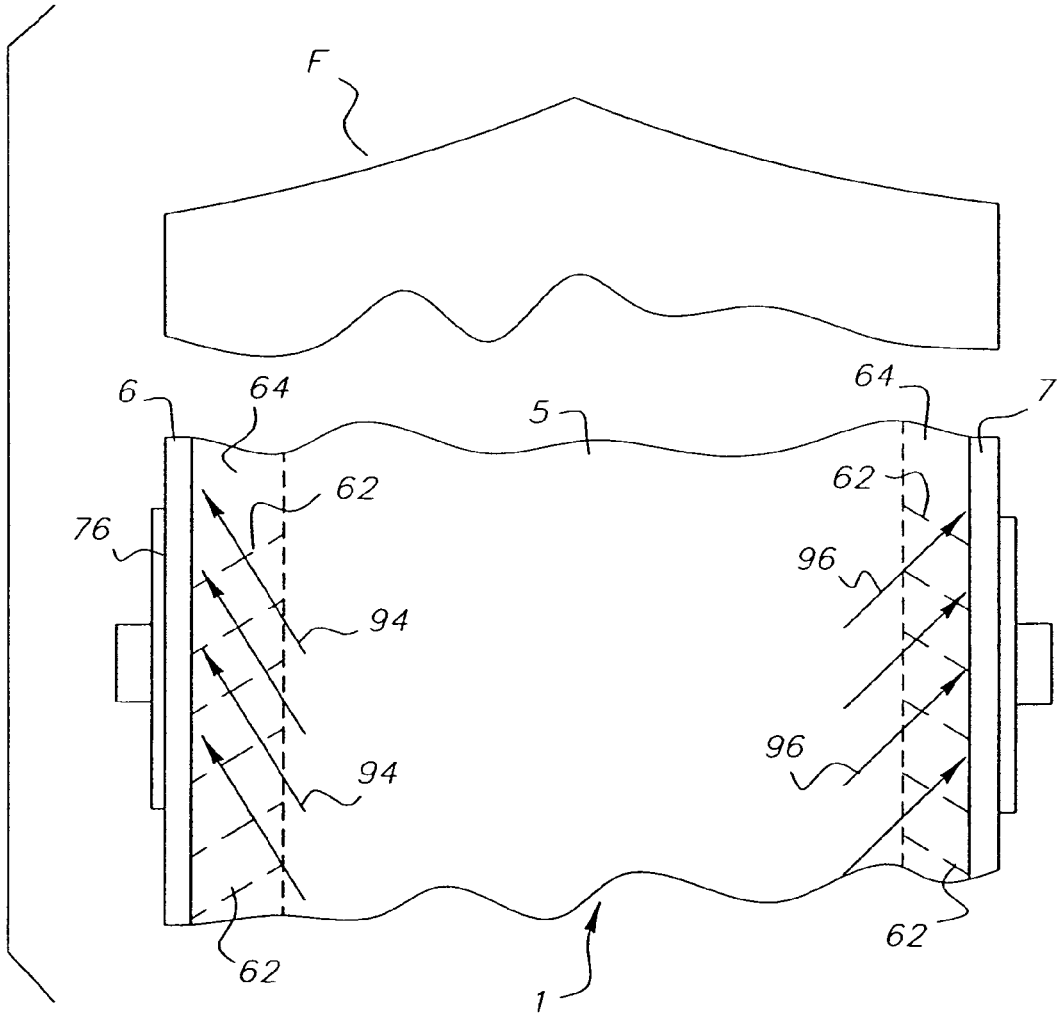
FIG. 13 is a plan view of a longitudinal portion of the dye donor web, depicting how the crease-preventing platen roller in FIGS. 10–12 operates to prevent crease formation.

During the dye transfer, the helical ribs 86 and 88 are temporarily deformed or bent towards the opposite roller ends 82 and 84 by the longitudinal tensioning of the dye transfer area 5 and two edge areas 6 and 7 at the print head 48. Such longitudinal tensioning is imposed by the forward pulling force F of the motorized take-up spool 54. The helical ribs 86 and 88, when deflected towards the roller ends 82 and 84, cause at least the regions 64 of the dye transfer area 5 in which the slanted creases 62 can form to spread in opposition to crease formation, so that the line artifacts 70, show in FIG. 9, will not be printed on the dye receiver sheet 12 as in the prior art. More specifically, in FIG. 13, the deflected ribs 86 and 88 (not shown) act to diagonally urge the dye donor web 1, including the two edge areas 6 and 7 and at least the adjacent regions 64, 64, in web spreading directions 94 and 96 to oppose crease formation.

Figure 14:
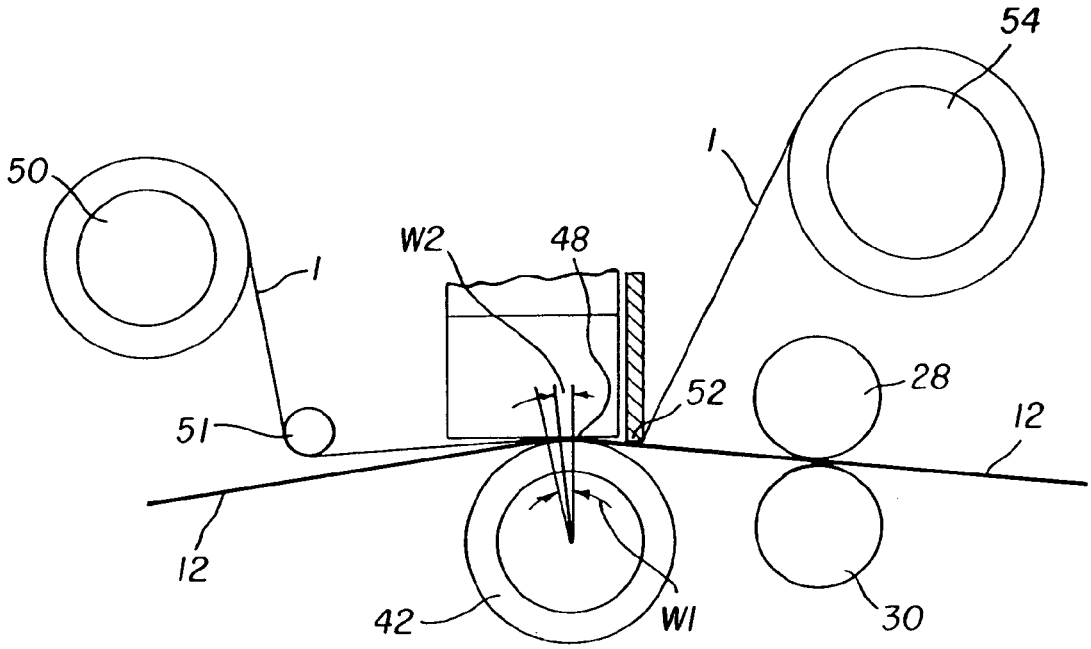
FIG. 14 (Prior Art)
FIG. 14 (PRIOR ART) is an elevation view, partly in section, of the dye transfer printer, depicting respective wrap angles of similar length portions of the dye receiver sheet and the dye donor web that are partially wrapped longitudinally about the prior art non-crease-preventing platen roller in FIGS. 2–6.

As shown in FIG. 14, when the platen roller 42 is moved to adjacent the print head 88, both the dye receiver sheet 12 and the dye transfer area 5 and two edge areas 6 and 7 are very slightly wrapped longitudinally about the platen roller, so that different wrap angles W1 and W2 are formed for the dye receiver sheet and the dye transfer area and two edge areas. The wrap angles W1 and W2 in FIG. 14 are maintained during the dye transfer, and are no more than 10° and 5° respectively.

Figure 15:
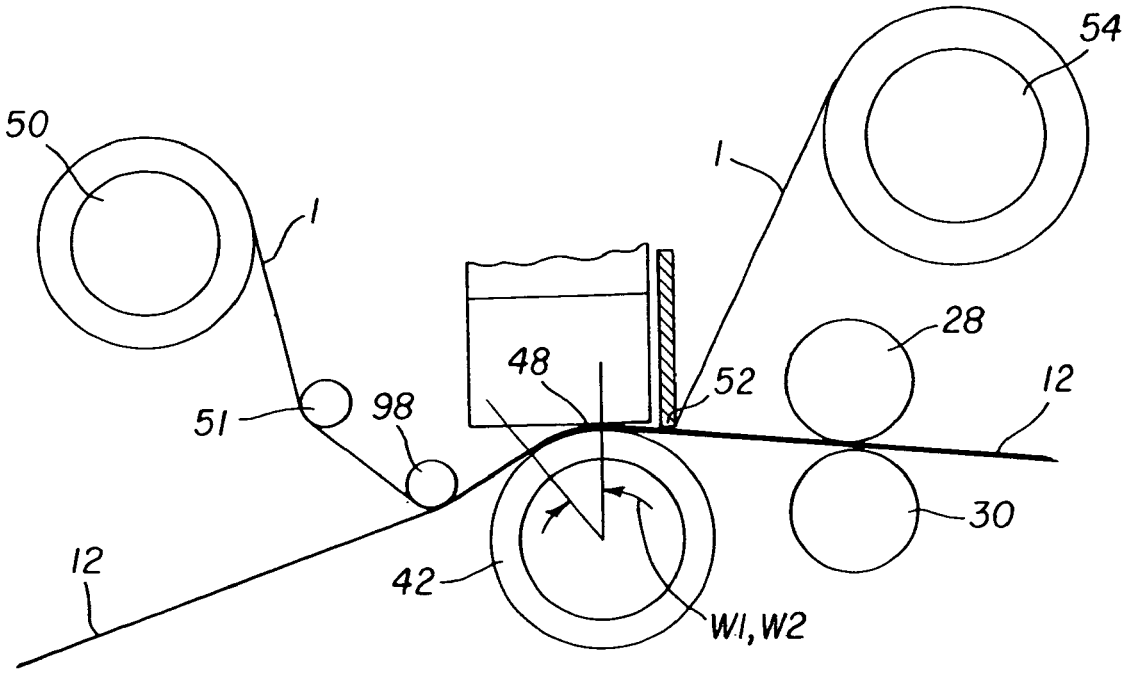
FIG. 15, in contrast to FIG. 14, is an elevation view, partly in section of the dye transfer printer, showing a wrap angle regulator movable for increasing the wrap angles of similar length portions of the dye donor web and the dye receiver sheet when they are partially wrapped about the crease-preventing platen roller in FIGS. 10–12, according to a preferred embodiment of the invention.
Figure 16:
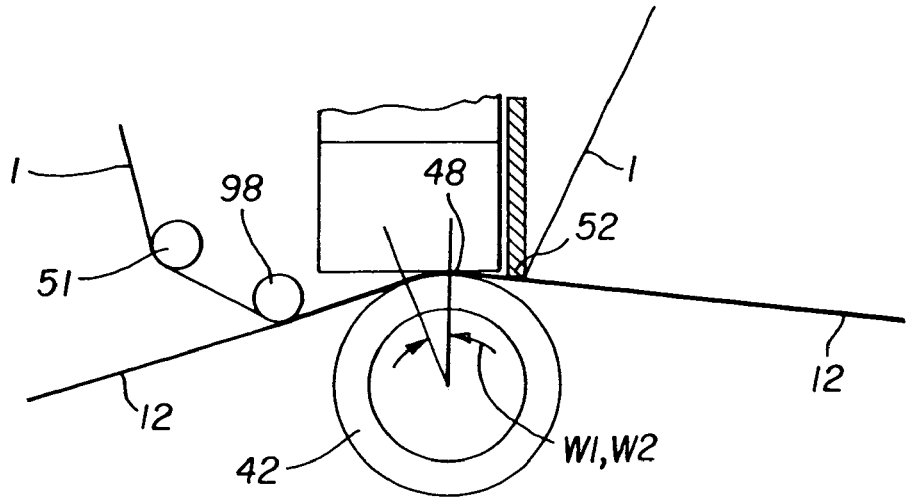
FIG. 16 is an elevation view similar to FIG. 15, showing the wrap angle regulator in a starting or beginning position in which the wrap angles of similar length portions of the dye donor web and the dye receiver sheet that are partially wrapped about the crease-preventing platen roller in FIGS. 10–12 is less than in FIG. 15 (but greater than in FIG. 14)

In contrast to FIG. 14, FIGS. 15 and 16 show a wrap angle regulator 98 that is movable for increasing the wrap angle W2 of the dye transfer area 5 and two edge areas 6 and 7 (and depending on the actual increase, possibly increasing the wrap angle W1 of the dye receiver sheet 12), when both the dye receiver sheet and the dye transfer area and two edge areas are partially wrapped about the crease-preventing platen roller 76. The crease-preventing platen roller 76 is positioned adjacent the print head 48 to effect the dye transfer. The wrap angle regulator 98 preferably is an idler roller, but can take other known forms such as a non-rotational web guide. The reason for increasing the wrap angle W2 of the dye transfer area 5 and two edge areas 6 and 7 is to allow the crease-preventing platen roller 76 to urge more, i.e. a longer portion, of the dye transfer area and two edge areas to spread in web spreading directions 94 and 96 to oppose crease formation as in FIG. 13.

FIG. 15, as compared to FIG. 14, shows the wrap angle regulator 98 moved to increase both the wrap angle W2 of the dye transfer area 5 and two edge areas 6 and 7 and the wrap angle W1 of the dye receiver sheet 12. In FIG. 15, the wrap angles W1 and W2 are each increased to 40°, so that they are the same as compared to FIG. 14. FIG. 16, as compared to FIG. 15, shows the wrap angle regulator 98 in a starting or beginning position in which both the wrap angle W2 of the dye transfer area 5 and two edge areas 6 and 7 and the wrap angle W1 of the dye receiver sheet 12 are each 20°. The wrap angle regulator 98 is movable to increase the wrap angles W1 and W2 from 20° to no more than 90° (although a preferred range is 20°–60°).

Figure 17:
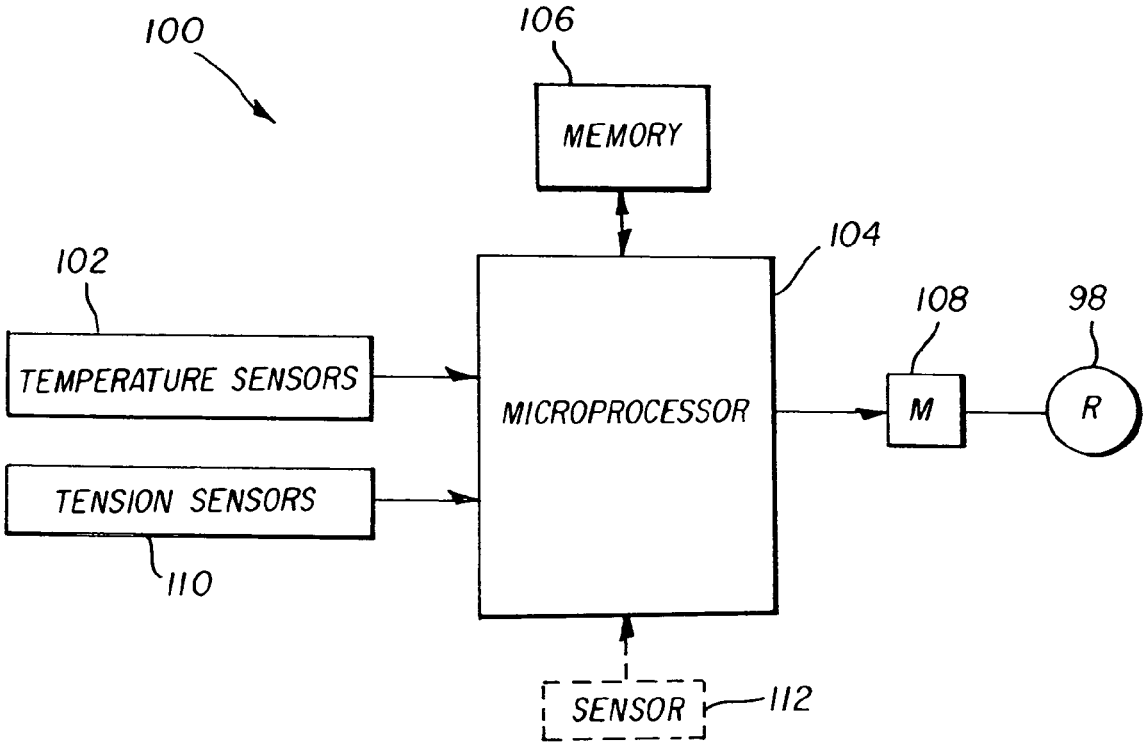
FIG. 17 is a block diagram of a sensor and control device for controlling movement of the wrap angle regulator.

FIG. 17 is a block diagram of a sensor and control device 100 for controlling movement of the wrap angle regulator 98. Generally speaking, the sensor and control device 100 is for sensing at least one variable that can cause longitudinal stretching of the dye transfer area 5 relative to the two edge areas 6 and 7 at the print head 48, preparatory to the dye transfer, and for determining whether the wrap angle W2 of the dye transfer area and two edge areas should be increased accordingly—so that the crease-preventing platen roller 76 can urge more of the dye transfer area and two edge areas to spread. In FIG. 15, the wrap angle regulator 98 is moved to increase both the wrap angle W2 of the dye transfer area 5 and two edge areas 6 and 7 and the wrap angle W1 of the dye receiver sheet 12 in accordance with the sensor and control device 100 determining that the wrap angle of the dye transfer area and two edge areas should be increased to 40°.

Preferably, the sensor and control device 100 includes a linear array of sensors 102, parallel to the linear array (bead) of selectively heated resistive elements 49A, 49A, *, 49B, 49B, *, 49A, 49A * on the print head 48, that sense a variable that can cause longitudinal stretching of the dye transfer area 5 relative to the two edge areas 6 and 7 at the print head, and provide representative output signals that are inputted to a microprocessor or control 104. See FIGS. 7 and 17. The variable that is sensed must be one that affects stretching of the dye transfer area 5 relative to the two edge areas 6 and 7 at the print head 48. For example, the variable may be temperature or heat sensed at a series of locations along the width W of the dye transfer area 5 and two edge areas 6 and 7, to indicate differences in temperature between the dye transfer area and two edge areas. In FIG. 17, the sensors 102 are temperature sensors that sense temperature widthwise across the dye transfer area 5 and two edge areas 6 and 7, and the microprocessor 104 determines whether differences in temperature between the dye transfer area and two edge areas makes the dye transfer area vulnerable to being stretched relative to the two edge areas. The microprocessor 104 employs a memory 106 that stores a look-up table to make the determination. This can be done in a known way such as by comparing temperatures sensed by the temperature sensors 102 with listed predetermined temperatures in the look-up table that will result in stretching of the dye transfer area 5 relative to the two edge areas 6 and 7. When it is determined that differences in temperatures between the dye transfer area 5 and two edge areas 6 and 7 makes the dye transfer area vulnerable to being stretched relative to the two edge areas, the microprocessor 104 selects a suitable wrap angle W1 for the dye transfer area and two edge areas from the look-up table and energizes a motor 108 to move the wrap angle regulator 98 accordingly to change the wrap angle for the dye transfer area and two edge areas. In FIG. 15, the wrap angle regulator 98 also changes the wrap angle W2 for the dye receiver sheet 12**.

Since the longitudinal tension imposed by the forward pulling force F of the donor web take-up spool 54 can longitudinally stretch the dye transfer area 5 relative to the two edge areas 6 and 7, there is preferably included another linear array of sensors 110, parallel to and adjacent the temperature sensors 102, that sense longitudinal tension at a series of locations along the width W of the dye transfer area 5 and two edge areas 6 and 7, and provide representative output signals that are inputted to the microprocessor 104. The microprocessor 104 via the look-up table determines whether longitudinal tension sensed by the tension sensors 102, in combination with temperatures sensed by the temperature sensors 106, also makes the dye transfer area 5 vulnerable to be stretched relative to the two edge areas 6 and 7. This can be done in a known way such as by comparing temperatures sensed by the temperature sensors 102 and tension sensed by the tension sensors 10 with listed predetermined combinations of temperatures and tension in the look-up table that will result in stretching of the dye transfer area 5 relative to the two edge areas 6 and 7. When it is determined that differences in temperature between the dye transfer area 5 and two edge areas 6 and 7 and/or longitudinal tension of the dye transfer area and two edge areas makes the dye transfer area vulnerable to being stretched relative to the two edge areas, the microprocessor 104 selects a suitable wrap angle W1 for the dye transfer area and two edge areas from the look-up table and energizes a motor 108 to move the wrap angle regulator 98 accordingly to change the wrap angle for the dye transfer area and two edge areas. In FIG. 15, the wrap angle regulator 98 also changes the wrap angle W2 for the dye receiver sheet 12.

A wrap angle sensor 112 for sensing the wrap angle W1 of the dye transfer area 5 and two edge areas 6 and 7 may optionally be included in the sensor and control device in FIG. 17. The wrap angle sensor 112 senses the wrap angle W1 of the dye transfer area 5 and two edge areas 6 and 7, and provides an input signal to the microprocessor 104 to enable the microprocessor to compare the wrap angle with a wrap angle in the look-up table that corresponds to a combination of temperature and tension in the look-up table that is closest to temperature and tension sensed by the temperature sensors 102 and tension sensors 10. This would be done to determine whether the wrap angle W1 of the dye transfer area 5 and two edge areas 6 and 7 should be changed.

Other Examples of Crease-preventing Platen Rollers for Use with Web Angle Regulator 98

Figure 18:
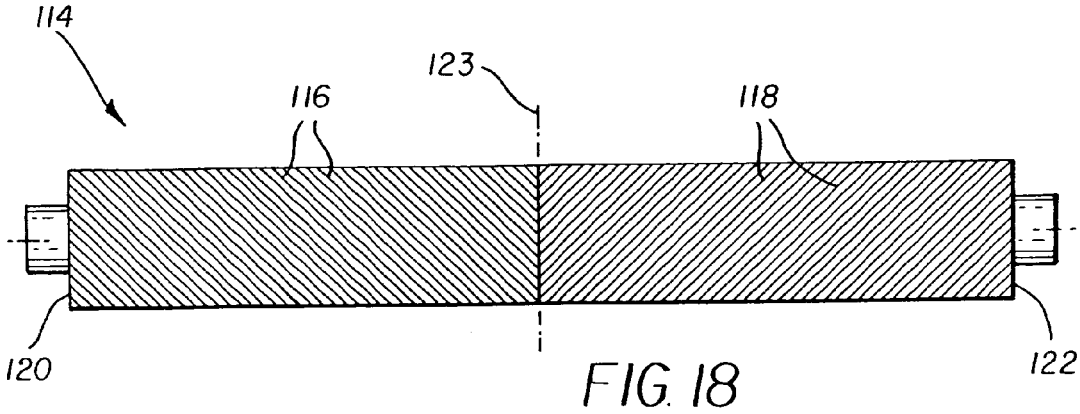
FIG. 18 is an elevation view of a second example of a crease-preventing platen roller that can be used with the wrap angle regulator.

FIG. 18 is a second example of a crease-preventing platen roller that can be used with the wrap angle regulator 98 when the platen roller is adjacent the print head 48 to effect the dye transfer. In FIG. 18, a crease-preventing platen roller 114 has separate diagonally wound fibers 116 and 118 that are similarly coiled inwardly from opposite coaxial ends 120 and 122 of the platen roller to be wound towards one another from the opposite roller ends. Preferably, the fibers 116 and 116 meet at a midpoint 123 on the crease-preventing platen roller 114 (although they need not extend that far from the opposite roller ends 120 and 122), and they are diagonally wound at a 45° inclination. In operation, when the dye transfer area 5 and two edge areas 6 and 7 are longitudinally tensioned because of the forward pulling force F of the motorized take-up spool 54, the fibers 116 and 118 cause at least the regions 64 of the dye transfer area 5 in which the slanted creases 62 can form to spread towards the opposite roller ends 120 and 122 in opposition to crease formation, so that the line artifacts 70, show in FIG. 9, will not be printed on the dye receiver sheet 12 as in the prior art. More specifically, in FIG. 13, the fibers 116 and 118 (not shown) act to diagonally urge the dye donor web 1, including the two edge areas 6 and 7 and at least the adjacent regions 64, 64, in web spreading directions 94 and 96, to oppose crease formation at the print head 48.

Figure 19:
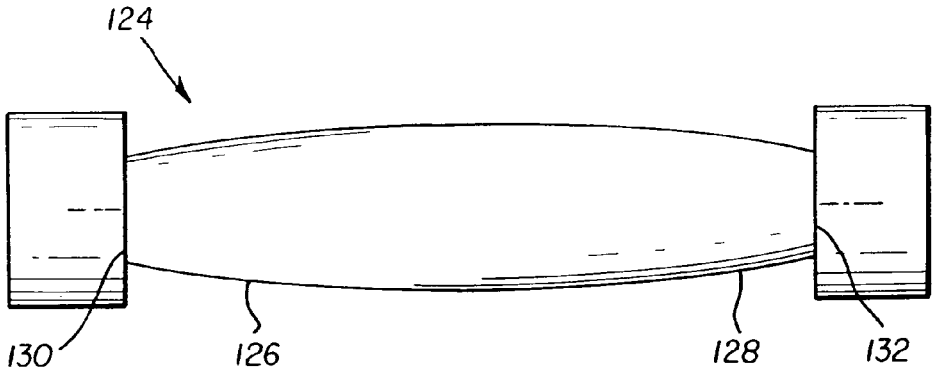
FIG. 19 is an elevation view of a third example of a crease-preventing platen roller that can be used with the wrap angle regulator.

FIG. 19 is a third example of a crease-preventing platen roller that can be used with the wrap angle regulator 98 when the platen roller is adjacent the print head 48 to effect the dye transfer. In FIG. 19, a crease preventing platen roller 124 has respective spaced web spreading portions 126 and 128 that are gradually tapered towards opposite coaxial ends 130 and 132 of the platen roller to allow the dye transfer area 5 and two edge areas 6 and 7 to spread towards the opposite roller ends in opposition to crease formation, when the dye transfer area and two edge areas are longitudinally tensioned because of the forward pulling force F of the motorized take-up spool 54.

Figure 20:
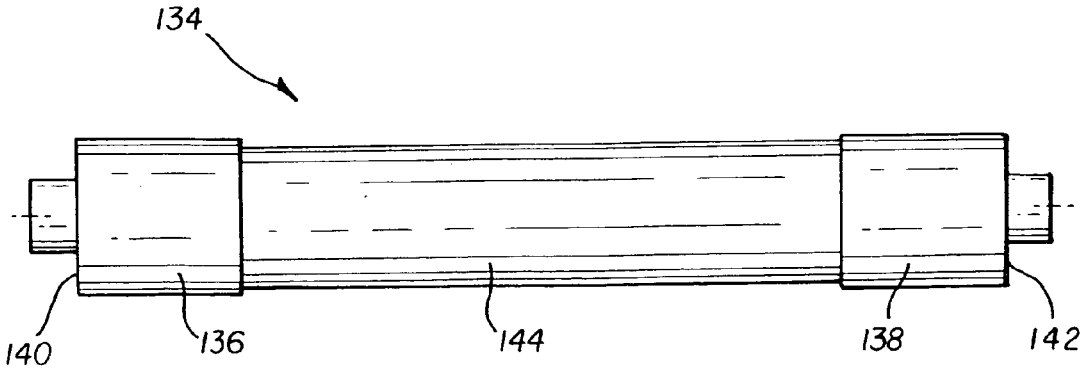
FIG. 20 is an elevation view of a fourth example of a crease- preventing platen roller that can be used with the wrap angle regulator.

FIG. 20 is a fourth example of a crease-preventing platen roller that can be used with the wrap angle regulator 98 when the platen roller is adjacent the print head 48 to effect the dye transfer. In FIG. 4, a crease-preventing platen roller 134 has respective spaced roller end portions 136 and 138 inwardly adjacent opposite coaxial ends 140 and 142 of the platen roller. The roller end portions 136 and 138 each have a diameter and a compliance, i.e. an ability to yield elastically, that is greater than at a roller main portion 144 between the roller end portions. The roller end portions 136 and 138 may have a rubber hardness of Shore A in the range of 30–80, and the roller main portion may have a rubber hardness of Shore A in the range of 40–90, to make the roller end portions more compliant than the roller end portion. When the crease-preventing platen roller 134 is adjacent the print head 48, the roller main portion 144 holds the dye transfer area 5 against the against the resistive elements 49B, 49B, *, and the roller end portions 136 and 138 hold the two edge areas 6 and 7 against the resistive elements 49A, 49A, *. The roller end portions 136 and 138 apply a compressive pressure/mechanical friction against the two edge areas 6 and 7 that is greater than the compressive pressure/mechanical friction that the main portion 144 applies against the dye transfer area 5. The compressive pressure/mechanical friction applied by roller end portions 136 and 138 against the two edge areas 6 and 7 is sufficient to cause the two edge areas to be longitudinally stretched substantially the same as the dye transfer area 5 at the print head 48. As a result, creases formation in the dye transfer area 5 is substantially prevented.

The invention has been described in detail with particular reference to certain preferred embodiments thereof, but it will be understood that variations and modifications can be effected within the spirit and scope of the invention.

PARTS LIST 1. dye donor web
2. yellow color section
3. magenta color section
4. cyan color section
5. dye transfer area
6. longitudinal edge area
7. longitudinal edge area
W. dye donor web width
10. thermal dye transfer printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller

44. cam
46. platen lift
48. thermal print head
49A, 49B. linear array (bead) of resistive elements
50. donor web supply spool
51. first stationary (fixed) donor web guide
52. second stationary (fixed) donor web guide
54. donor web take-up spool
55. donor web cartridge
56. diverter
58. exit tray
60. exit roller
61. exit roller
F. forward pulling force
62. slanted creases or wrinkles
64. donor web regions
66. trailing or rear end portion
68. leading or front end portion
70. line artifacts
72. leading or front end portion
74. heat activating control
76. crease-preventing platen web roller
78. helical groove
80. helical groove
82. roller end
84. roller end
86. helical rib
88. helical rib
90. web traction surface layer
92. web traction surface layer
A. rib angle
B. rib width
R. roller radius
C. groove width
H. rib height
94. web spreading direction
96. web spreading direction
W1. wrap angle
W2. wrap angle
98. wrap angle regulator
100. sensor and control device
102. linear array of temperature sensors
104. microprocessor or control
106. memory
108. motor
110. linear array of tension sensors
112. wrap angle sensor
114. crease-preventing platen roller
116. diagonally wound fiber
118. diagonally wound fiber
120. roller end
122. roller end
123. midpoint
124. crease-preventing platen roller
126. web spreading portion
128. web spreading portion
130. roller end
132. roller end
134. crease-preventing platen roller
136. roller end portion
138. roller end portion
140. roller end
142. roller end
144. roller main portion

What is claimed is:

1. A thermal printer capable of preventing crease formation in successive dye transfer areas of a dye donor web that can cause line artifacts to be printed on a dye receiver during dye transfer from each dye transfer area to the dye receiver, said printer comprising:

a thermal print head for heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

a crease-preventing platen roller movable to adjacent said print head for supporting both the dye receiver and the dye transfer area and two edge areas partially wrapped longitudinally about said platen roller, so that respective wrap angles are formed for the dye receiver and for the dye transfer area and two edge areas relative to said platen roller, and being configured to urge the dye transfer area and two edge areas to spread in opposition to crease formation during dye transfer from the dye transfer area to the dye receiver; and a wrap angle regulator movable for increasing at least the wrap angle of the dye transfer area and two edge areas relative to said crease-preventing platen roller, whereby said platen roller can urge more of the dye transfer area and two edge areas to spread.

2. A thermal printer as recited in claim 1, wherein a sensor and control device senses at least one variable that can cause longitudinal stretching of the dye transfer area relative to the two edge areas and determines whether the wrap angle of the dye transfer area and two edge areas relative to said crease-preventing platen roller should be increased, and said wrap angle regulator moves to increase at least the wrap angle of the dye transfer area and two edge areas relative to said crease-preventing platen roller in accordance with said sensor and control device determining that the wrap angle of the dye transfer area and two edge areas should be increased.

3. A thermal printer as recited in claim 2, wherein a donor web take-up can longitudinally tension the dye transfer area and two edge areas at said print head sufficiently to longitudinally stretch the dye transfer area relative to the two edge areas when the dye transfer area is heated to cause dye transfer to the dye receiver, and said sensor and control device senses temperature and longitudinal tension widthwise across the dye transfer area and two edge areas at said print head to determine whether the wrap angle of the dye transfer area and two edge areas relative to said crease-preventing platen roller should be increased.

4. A thermal printer as recited in claim 3, wherein said sensor and control device includes a look-up table that lists various combinations of temperature and tension and lists a preferred wrap angle for each combination of temperature and tension.

5. A thermal printer as recited in claim 4, wherein said sensor and control device senses the wrap angle of the dye transfer area and two edge areas relative to said crease-preventing platen roller and compares the wrap angle with a wrap angle in said look-up table that corresponds to a combination of temperature and tension in said look-up table that is closest to temperature and tension sensed by said sensor and control device in order to determine whether the wrap angle of the dye transfer area and two edge areas relative to said crease-preventing platen roller should be increased.

6. A thermal printer as recited in claim 1, wherein said wrap angle regulator is movable to increase the wrap angle for the dye transfer area and two edge areas relative to said crease-preventing platen roller from 20° to no more than 90°.

7. A thermal printer as recited in claim 1, wherein a donor web take-up can longitudinally tension the dye transfer area and two edge areas at said print head sufficiently to longitudinally stretch the dye transfer area relative to the two edge areas when the dye transfer area is heated to cause dye transfer to the dye receiver, and said crease-preventing platen roller has respective web spreading portions that are similarly spiraled inwardly from opposite coaxial ends of said platen roller to urge the dye transfer area and two edge areas to spread towards said coaxial ends in opposition to crease formation when the dye transfer area and two edge areas are longitudinally tensioned.

8. A thermal printer as recited in claim 7, wherein said web spreading portions are respective helical grooves similarly spiraled inwardly from said coaxial ends of said crease-preventing platen roller to form resilient helical ribs that can be deformed towards said coaxial ends by longitudinal tensioning of the dye transfer area and two edge areas in order for said ribs to spread the dye transfer area and two edge areas towards said coaxial ends.

9. A thermal printer as recited in claim 7, wherein said web spreading portions are respective diagonally wound fibers similarly coiled inwardly from said coaxial ends of said crease-preventing platen roller to be wound towards one another from said coaxial ends.

10. A thermal printer as recited in claim 1, wherein a donor web take-up can longitudinally tension the dye transfer area and two edge areas at said print head sufficiently to longitudinally stretch the dye transfer area relative to the two edge areas when the dye transfer area is heated to cause dye transfer to the dye receiver, and said crease-preventing platen roller has respective web spreading portions that are gradually tapered towards opposite coaxial ends of said platen roller to allow the dye transfer area and two edge areas to spread towards said coaxial ends in opposition to crease formation when the dye transfer area and two edge areas are longitudinally tensioned.

11. A thermal printer capable of preventing crease formation in successive dye transfer areas of a dye donor web that can cause line artifacts to be printed on a dye receiver during dye transfer from each dye transfer area to the dye receiver, said printer comprising:

a thermal print head for heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

a donor web take-up that can longitudinally tension the dye transfer area and two edge areas at said print head sufficiently to longitudinally stretch the dye transfer area relative to the two edge areas when the dye transfer area is heated to cause dye transfer to the dye receiver;

a crease-preventing platen roller movable to adjacent said print head for supporting both the dye receiver and the dye transfer area and two edge areas partially wrapped longitudinally about said platen roller, so that respective wrap angles are formed for the dye receiver and for the dye transfer area and two edge areas relative to said platen roller, and being configured to urge the dye transfer area and two edge areas to spread in opposition to crease formation during dye transfer from the dye transfer area to the dye receiver;

a sensor and control device for sensing temperature and/or longitudinal tension widthwise with respect to the dye transfer area and two edge areas at said print head to determine whether the wrap angle of the dye transfer area and two edge areas relative to said crease-preventing platen roller should be increased in order for said platen roller to urge more of the dye transfer area and two edge areas to spread; and a wrap angle regulator movable to increase the wrap angle of the dye transfer area and two edge areas relative to said crease-preventing platen roller in accordance with said sensor and control device determining that the wrap angle of the dye transfer area and two edge areas should be increased.

12. A thermal printer as recited in claim 11, wherein said sensor and control device senses temperature widthwise with respect to the dye transfer area and two edge areas at said print head and determines whether differences in temperature sensed between the dye transfer area and two edge areas makes the dye transfer area vulnerable to being stretched relative to the two edge areas.

13. A thermal printer as recited in claim 12, wherein said sensor and control device senses longitudinal tension widthwise with respect to the dye transfer area and two edge areas at said print head and determines whether longitudinal tension sensed in combination with differences in temperature sensed makes the dye transfer area vulnerable to be stretched relative to the two edge areas.

14. A method in a thermal printer of preventing crease formation in successive dye transfer areas of a dye donor web that can cause line artifacts to be printed on a dye receiver during dye transfer from each dye transfer area to the dye receiver, said method comprising:

heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

supporting both the dye receiver and the dye transfer area and two edge areas on a crease-preventing platen roller that can urge the dye transfer area and two edge areas to spread in opposition to crease formation during dye transfer from the dye transfer area to the dye receiver, and with both the dye receiver and the dye transfer area and two edge areas partially wrapped longitudinally about the crease-preventing platen roller to create respective wrap angles for the dye receiver and for the dye transfer area and two edge areas relative to the platen roller; and increasing at least the wrap angle of the dye transfer area and two edge areas relative to the crease-preventing platen roller, whereby the platen roller can urge more of the dye transfer area and two edge areas to spread.

15. A method in a thermal printer of preventing crease formation in successive dye transfer areas of a dye donor web that can cause line artifacts to be printed on a dye receiver during dye transfer from each dye transfer area to the dye receiver, said method comprising:

heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

supporting both the dye receiver and the dye transfer area and two edge areas on a crease-preventing platen roller that can urge the dye transfer area and two edge areas to spread in opposition to crease formation during dye transfer from the dye transfer area to the dye receiver, and with both the dye receiver and the dye transfer area and two edge areas partially wrapped longitudinally about the crease-preventing platen roller to create respective wrap angles for the dye receiver and for the dye transfer area and two edge areas relative to the platen roller;

sensing at least one variable that can cause longitudinal stretching of the dye transfer area relative to the two edge areas, and determining whether the wrap angle of the dye transfer area and two edge areas relative to the crease-preventing platen roller should be increased in order for the platen roller to urge more of the dye transfer area and two edge areas to spread; and increasing at least the wrap angle of the dye transfer area and two edge areas relative to the crease-preventing platen roller when it is determined that the wrap angle of the dye transfer area and two edge areas should be increased.

16. A method as recited in claim 15, wherein temperature and/or longitudinal tension are sensed widthwise with respect to the dye transfer area and two edge areas to determine whether the wrap angle of the dye transfer area and two edge areas relative to the crease-preventing platen roller should be increased.

17. A thermal printer capable of preventing crease formation in successive dye transfer areas of a dye donor web that can cause line artifacts to be printed on a dye receiver during dye transfer from each dye transfer area to the dye receiver, said printer comprising:

a thermal print head for heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

a crease-preventing platen roller movable to adjacent said print head for supporting both the dye receiver and the dye transfer area and two edge areas partially wrapped longitudinally about said platen roller, so that respective wrap angles are formed for the dye receiver and for the dye transfer area and two edge areas relative to said platen roller, and being configured to apply mechanical friction to the two edge areas that is sufficient to cause the two edge areas to be longitudinally stretched substantially the same as the dye transfer area during dye transfer from the dye transfer area to the dye receiver, so that crease formation is prevented; and a wrap angle regulator movable for increasing at least the wrap angle of the dye transfer area and two edge areas relative to said crease-preventing platen roller, whereby said platen roller can apply friction to more of the two edge areas.

18. A thermal printer as recited in claim 17, wherein said crease-preventing platen roller has a diameter and a compliance that is greater at opposite roller end portions than at a roller main portion, and said roller end portions and roller main portion are dimensioned for said roller main portion to support the dye transfer area partially wrapped longitudinally about said platen roller and said roller end portions to support the two edge areas partially wrapped longitudinally about said platen roller, so that said roller end portions can apply a compressive pressure against the two edge areas that is greater than a compressive pressure said roller end portion can apply against the dye transfer area, to apply the friction to the two edge areas that is sufficient to cause the two edge areas to be longitudinally stretched substantially the same as the dye transfer area.

19. A method in a thermal printer of preventing crease formation in successive dye transfer areas of a dye donor web that can cause line artifacts to be printed on a dye receiver during dye transfer from each dye transfer area to the dye receiver, said method comprising:

heating a dye transfer area of the dye donor web sufficiently to cause dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly form creases in the dye transfer area;

supporting both the dye receiver and the dye transfer area and two edge areas on a crease-preventing platen roller that can apply mechanical friction to the two edge areas that is sufficient to cause the two edge areas to be longitudinally stretched substantially the same as the dye transfer area during dye transfer from the dye transfer area to the dye receiver, so that crease formation is prevented, and with both the dye receiver and the dye transfer area and two edge areas partially wrapped longitudinally about the crease-preventing platen roller to create respective wrap angles for the dye receiver and for the dye transfer area and two edge areas relative to the platen roller; and increasing at least the wrap angle of the dye transfer area and two edge areas relative to the crease-preventing platen roller, whereby the platen roller can apply friction to more of the two edge areas.

* * * * *